US008059985B2

(12) United States Patent
Inoue

(10) Patent No.: US 8,059,985 B2
(45) Date of Patent: Nov. 15, 2011

(54) IMAGE FORMING APPARATUS WITH ACCURATELY POSITIONABLE CLEANING UNIT FOR CLEANING A TRANSFER UNIT

(75) Inventor: Mutsumi Inoue, Osaka (JP)

(73) Assignee: Kyocera Mita Corporation (JP)

( * ) Notice: Subject to any disclaimer, the term of this patent is extended or adjusted under 35 U.S.C. 154(b) by 442 days.

(21) Appl. No.: 12/358,085

(22) Filed: Jan. 22, 2009

(65) Prior Publication Data

US 2009/0196648 A1 Aug. 6, 2009

(30) Foreign Application Priority Data

Jan. 31, 2008 (JP) ..... 2008-021354

(51) Int. Cl.
*G03G 15/16* (2006.01)

(52) U.S. Cl. ..... 399/101

(58) Field of Classification Search ..... 399/101, 399/302, 121, 308
See application file for complete search history.

(56) References Cited

U.S. PATENT DOCUMENTS 6,865,361 B2 * 3/2005 Abe et al. ..... 399/302
2007/0048014 A1 3/2007 Mori
2007/0147878 A1 6/2007 Mori

FOREIGN PATENT DOCUMENTS

JP 09311522 A * 12/1997
JP 2000-19861 1/2000
JP 2007225742 A * 9/2007

* cited by examiner

*Primary Examiner* — Quana M Grainger
(74) *Attorney, Agent, or Firm* — Gerald E. Hespos; Michael J. Porco

(57) ABSTRACT

A transfer unit includes: a plurality of rollers; an image forming section which performs formation of a toner image in accordance image information and transfer of the toner image; an intermediate transferring belt to which the toner image is transferred from the image forming section; and a contact member which comes in contact with a part of the cleaning unit at a position apart from the intermediate transferring belt to perform positioning of the cleaning unit, and the cleaning unit includes: a cleaning mechanism which cleans the front surface side of the intermediate transferring belt; a positioning shaft which fits into the positioning portion formed in the apparatus main body, the positioning shaft being rotatable in such a direction as to come in contact with or separate apart from the transfer unit; and an abutting member which comes in contact with the contact member of the transfer unit.

8 Claims, 10 Drawing Sheets

IMAGE FORMING APPARATUS WITH ACCURATELY POSITIONABLE CLEANING UNIT FOR CLEANING A TRANSFER UNIT

BACKGROUND OF THE INVENTION

1. Field of the Invention

The present invention relates to an image forming apparatus, a transfer unit, and a cleaning unit. Specifically, it relates to a technique of mounting each unit to a main body of an image forming apparatus.

2. Description of the Related Art

Conventionally, in views of improving accuracy in mounting a cleaning mechanism which cleans an intermediate transferring belt, maintainability and assembly of a unit, and demands in reducing a space, there has been proposed an image forming apparatus including a unit in which a transfer mechanism which retains an intermediate transferring belt is integrated with the cleaning mechanism (for example, Japanese Unexamined Patent Publication No. 2000-19861). In the case of the unit, in which the conventional transfer unit is integrated with the cleaning unit, adopted in the image forming apparatus, whole mechanisms of the unit are replaced at a time of repair or failure of the unit. For example, in the aforementioned unit, even if only the intermediate transferring belt should be replaced, all parts (image forming section, belt driving roller, and the like) which are mounted around an outer peripheral surface of the intermediate transferring belt of the unit are dismounted and replaced.

SUMMARY OF THE INVENTION

The present invention was made by further improving the conventional technique.

In summary, an image forming apparatus in accordance with an aspect of the present invention includes: a transfer unit; a cleaning unit; and an apparatus main body to which the transfer unit and the cleaning unit are mounted. The transfer unit includes: a plurality of rollers; an image forming section which performs formation of a toner image in accordance with image information and transfer of the toner image; a transfer belt which extends between the plurality of rollers so as to be capable of running in an endless manner, the transfer belt receiving on its front surface or a recording sheet placed on the front surface a toner image which is transferred from the image forming section; and a contact member which comes in contact with a part of the cleaning unit at a position apart from the transfer belt to perform positioning of the cleaning unit. The apparatus main body includes: a positioning portion which is used for positioning the cleaning unit, and the cleaning unit includes: a cleaning mechanism which cleans the front surface side of the transfer belt; a positioning shaft which fits into the positioning portion formed in the apparatus main body of the image forming apparatus, the positioning shaft being rotatable in such a direction that the cleaning unit comes in contact with or separates apart from the transfer unit; and an abutting member which comes in contact with the contact member of the transfer unit.

These and other objects, features and advantages of the present invention will become more apparent upon reading of the following detailed description along with the accompanied drawings.

DETAILED DESCRIPTION OF THE PREFERRED EMBODIMENTS

Hereinafter, a transfer unit, a cleaning unit, and an image forming apparatus in accordance with an aspect of the present invention will be described.

Figure 1:
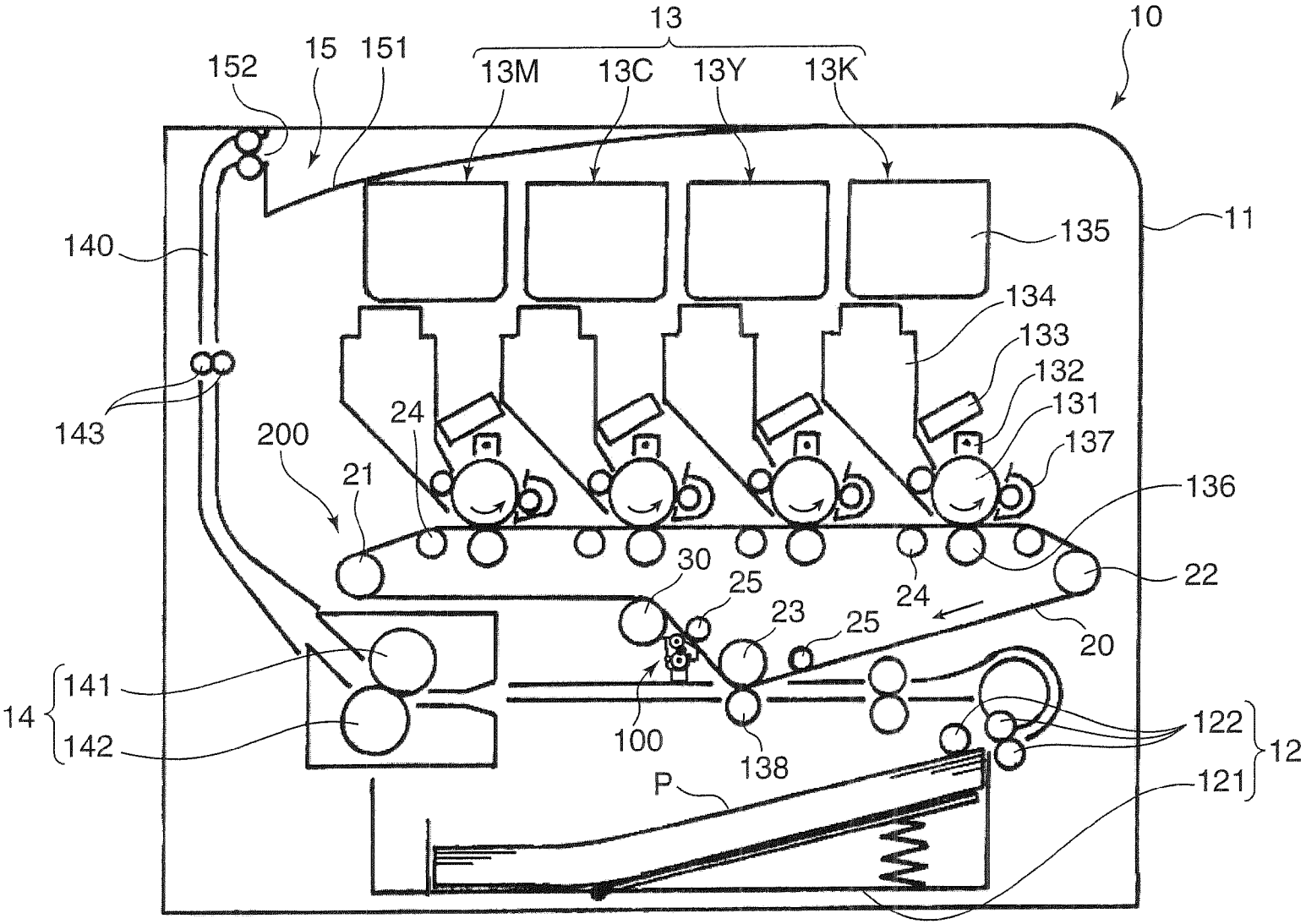
FIG. 1 is an explanatory drawing showing a cross-sectional view of an internal structure of an image forming apparatus in accordance with an embodiment of the present invention.
Figure 2:
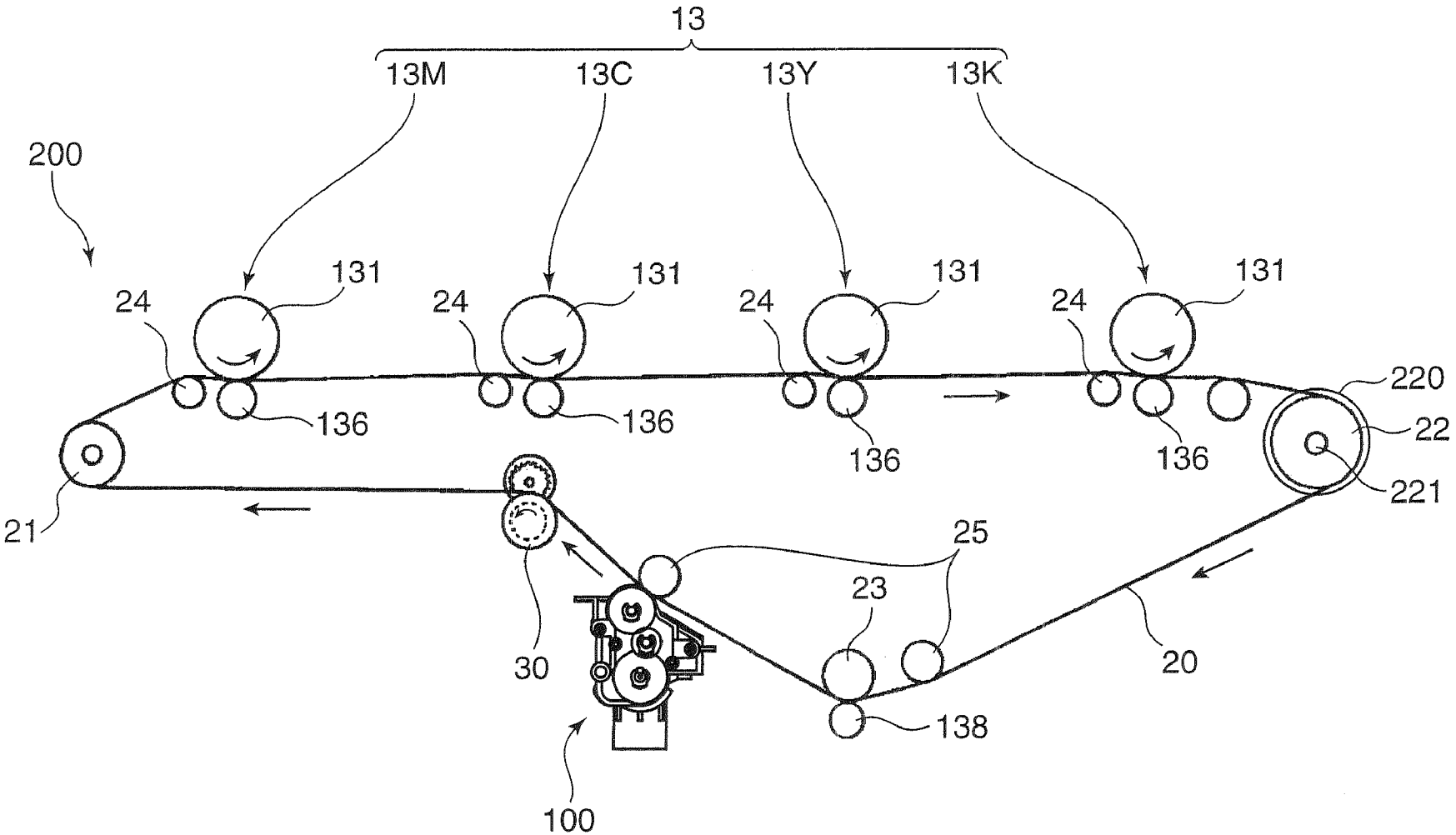
FIG. 2 extractively shows a transfer unit and a cleaning unit in accordance with an embodiment of the present invention.

FIG. 1 is an explanatory drawing showing a cross-sectional view of an internal structure of an image forming apparatus in accordance with an embodiment of the present invention. FIG. 2 extractively shows a transfer unit and a cleaning unit in accordance with an embodiment of the present invention.

In the present embodiment, a printer 10 is adopted as the image forming apparatus. As shown in FIG. 1, the printer 10 includes a sheet-supplying section 12 which stores a stack of sheets P, an image forming section 13 which transfers a toner image onto a sheet P conveyed from the sheet-supplying section 12, a fixing section 14 which applies a fixing processing to the toner image transferred to the sheet P by the image forming section 13, and a sheet-discharging section 15 to which the sheet P applied with the fixing processing by the fixing section 14 is discharged, each of which is mounted to an apparatus main body (an embodiment of an apparatus main body of an image forming apparatus in claims) 11.

The sheet-supplying section 12 includes a sheet-supplying cassette 121 which is dismountably mounted in a lower portion of the apparatus main body 11 and capable of storing a plurality of sheets P, and a pickup roller 122 provided at an upper right position above the sheet-supplying cassette 121 in FIG. 1. The sheets P stored in the sheet-supplying cassette 121 are picked up one after another by driving of the pickup roller 122 and sent to the image forming section 13.

The image forming section 13 is adapted to form a toner image onto the sheet P supplied from the sheet-supplying section 12 and, in the present embodiment, includes a magenta unit 13M using magenta toner, a cyan unit 13C using cyan toner, a yellow unit 13Y using yellow toner, and a black unit 13K using black toner, all of which are sequentially arranged from an upstream side (left side on a sheet of FIG. 1) to a downstream side.

Each of the units 13M, 13C, 13Y, and 13K includes a photoconductive drum (image bearing member) 131 which has a peripheral surface on which an electrostatic latent image and a toner image based on the electrostatic latent image are formed and is rotatable about an axis extending in forward and backward direction (direction orthogonal to the sheet of FIG. 1), a charging device 132 having a charging wire which charges the peripheral surface of the photoconductive drum 131 to form a uniform electric charge on the peripheral surface, an exposure device 133 which irradiates a laser light based on image information onto the peripheral surface of the photoconductive drum 131 applied with the uniform electric charge by the charging device 132 to form an electrostatic latent image, a developing device 134 which supplies toner onto the peripheral surface of the photoconductive drum 131 formed with the electrostatic latent image to form a toner image on the peripheral surface, a toner container 135 which supplies toner to the developing device 134 and is dismountably mounted to each developing device 134, a primary transferring roller 136 which transfers the toner image formed on the photoconductive drum 131 to the front surface of an intermediate transferring belt (an embodiment of a transferring belt in claims) 20, which will be described later, by peeling off the toner image electrostatically, and a drum cleaning device 137 which performs a cleaning processing with respect to the peripheral surface of the photoconductive drum 131 after the transferring processing to the intermediate transferring belt 20 is performed.

Further, in the image forming section 13, as common members for each of the units 13M, 13C, 13Y, and 13K, there are provided an intermediate transferring belt 20 whose upper portion comes in contact with a lower portion of each photoconductive drum 131 and onto which a toner image formed on the peripheral surface of the photoconductive drum 131 is transferred, and a secondary transferring roller 138 which peels off the toner image formed on the intermediate transferring belt 20 electrostatically and allows the toner image to be transferred onto the sheet P sent from the sheet-supplying section 12.

The photoconductive drum 131 is adapted to allow an electrostatic latent image and a toner image based on the electrostatic latent image to be formed on the peripheral surface, and an extremely flat and smooth amorphous silicon layer which is tough and excellent in abrasion resistance is layered on the peripheral surface so as to be suitable to form those images. Each photoconductive drum 131 rotates in a counter-clockwise direction in FIG. 1 and receives supply of toner from a corresponding developing device 134.

The charging device 132 is applied at its charging wire with a high voltage by an unillustrated power source, and a corona discharge caused by this forms a uniform electric charge on the peripheral surface of the photoconductive drum 131. In place of the charging device 132, a charging roller applied with a high voltage may come in contact with the peripheral surface of the photoconductive drum 131, so as to form an electric charge on the peripheral surface of the photoconductive drum 131.

The exposure device 133 is adapted to irradiate a laser light, which is based on image data inputted from an unillustrated computer or the like, to the peripheral surface of the photoconductive drum 131 uniformly charged by the charging device 132. The irradiation of the laser light forms the electrostatic latent image on the peripheral surface of the photoconductive drum 131. Supplying toner from the developing device 134 to the electrostatic latent image causes a toner image to be formed on the peripheral surface of the photoconductive drum 131, and then the toner image is transferred to the intermediate transferring belt 20 on which the toner image moves around.

The developing device 134 is provided with an agitating/conveying member inside, and a developing roller whose peripheral surface faces the peripheral surface of the photoconductive drum 131 is provided at a lowermost position. Rotation of the developing roller allows toner to be supplied to the peripheral surface of the photoconductive drum 131.

Onto the front surface of the intermediate transferring belt 20, toner images formed on peripheral surfaces of the photoconductive drums 131 in the respective units 13M, 13C, 13Y, and 13K are transferred sequentially in superimposition. Accordingly, a color image is formed on the front surface.

The transfer unit 200 in accordance with an embodiment of the present invention includes a driving roller 22, a tension roller 21, pressing roller 23, a driven roller 25, an intermediate transferring belt 20, and a bending roller 30.

The intermediate transferring belt 20 extends to be wound around primary transferring rollers 136 for the units 13M, 13C, 13Y, and 13K, a tension roller 21 provided on a slightly left position of the primary transferring roller 136 of the magenta unit 13M in FIG. 2, a driving roller 22 provided on a slightly right position of the primary transferring roller 136 of the black unit 13K in FIG. 2, a bending roller 30 which is provided, in the present embodiment, immediately under the primary transferring roller 136 of the cyan unit 13C on right of the tension roller 21 to bend the intermediate transferring belt 20, and a pressing roller 23 which is provided at a substantially intermediate position between and under the bending roller 30 and the driving roller 22.

The pressing roller 23 is adapted to press the intermediate transferring belt 20 against the secondary transferring roller 138 to thereby allow the color image formed on the intermediate transferring belt 20 to be reliably transferred to the sheet P which is conveyed in a state of being sandwiched between the intermediate transferring belt 20 and the secondary transferring roller 138.

The driving roller 22 is driven by the roller-driving motor (roller-driving power source) 220. The roller-driving motor 220 is provided on a back side (back side of the sheet of FIG. 2) of the driving roller 22 coaxially with the driving roller 22. The driving roller 22 fits over the driving shaft 221 of the roller-driving motor 220 integrally rotatably. Thus, the driving roller 22 is integrally rotated about the driving shaft 221 of the roller-driving motor 220 by driving of the roller-driving motor 220.

The respective peripheral surfaces of the driving roller 22, the tension roller 21, the pressing roller 23, and the primary transferring roller 136 come in contact with a back surface side of the intermediate transferring belt 20. On the other hand, the peripheral surface of the bending roller 30 comes in contact with the front surface side of the intermediate transferring belt 20.

The transfer unit 200 in accordance with the embodiment of the present invention includes the driving roller 22, the tension roller 21, the pressing roller 23, the intermediate transferring belt 20, and the bending roller 30.

The secondary transferring roller 138 is pressed by the pressing roller 23 across the intermediate transferring belt 20 at a position immediately under the pressing roller 23. The secondary transferring roller 138 is applied with a bias voltage, which electrostatically peels off the toner image formed on the intermediate transferring belt 20, from an unillustrated power source. Thus, a toner image on the intermediate transferring belt 20 is transferred to the sheet P which passes through a portion between the intermediate transferring belt 20 and the secondary transferring roller 138.

Further, an upper driven roller 24 is provided on a left side of each primary transferring roller 136, and driven rollers 25 are provided respectively at positions between the bending roller 30 and the pressing roller 23 and between the driving roller 22 and the pressing roller 23. The upper and lower driven rollers 24 and 25 press the intermediate transferring belt 20 from an inner side to maintain a tensional state so that the intermediate transferring belt 20 is not loosened.

Further, at a position facing the driven roller 25, which is provided on a left side in FIGS. 1 and 2, across the intermediate transferring belt 20, there is provided a belt cleaning device (an embodiment of the cleaning unit of the present invention) 100 for performing a processing of cleaning the surface of the intermediate transferring belt 20 after the transfer processing with respect to the sheet P. The intermediate transferring belt 20 applied with the cleaning processing by the cleaning unit 100 passes through the bending roller 30 and thereafter moves to the respective photoconductive drums 131 of the units 13M, 13C, 13Y, and 13K for the next transfer processing.

The fixing section 14 is adapted to apply a fixing processing to the image transferred to the sheet P in the image forming section 13 and includes a fixing roller 141 heated by an electric heating member such as a halogen lamp, and a pressing roller 142 which is so arranged as to face the fixing roller 141 in a lower portion and whose peripheral surface comes in press-contact with the peripheral surface of the fixing roller 141. As shown in FIG. 1, the fixing section 14 is arranged in a space formed by the pressure applied to the intermediate transferring belt 20 by the bending roller 30.

The sheet P to which the toner image is transferred from the intermediate transferring belt 20 by the secondary transferring roller 138 is led into the fixing section 14 while guided by rotation of the intermediate transferring belt 20 in a state of being sandwiched between the intermediate transferring belt 20 and the secondary transferring roller 138, so that the toner image is fixed to the sheet P by a heat applied when passing through a portion between the fixing roller 141 and the pressing roller 142.

The sheet P after being applied with the fix processing is conveyed upward through the sheet-discharging conveying passage 140 by driving of a pair of sheet-discharging rollers 143, passes through a sheet-discharging opening 152, and then is discharged to the sheet-discharging tray 151 provided on the top of the apparatus main body 11.

Figure 3:
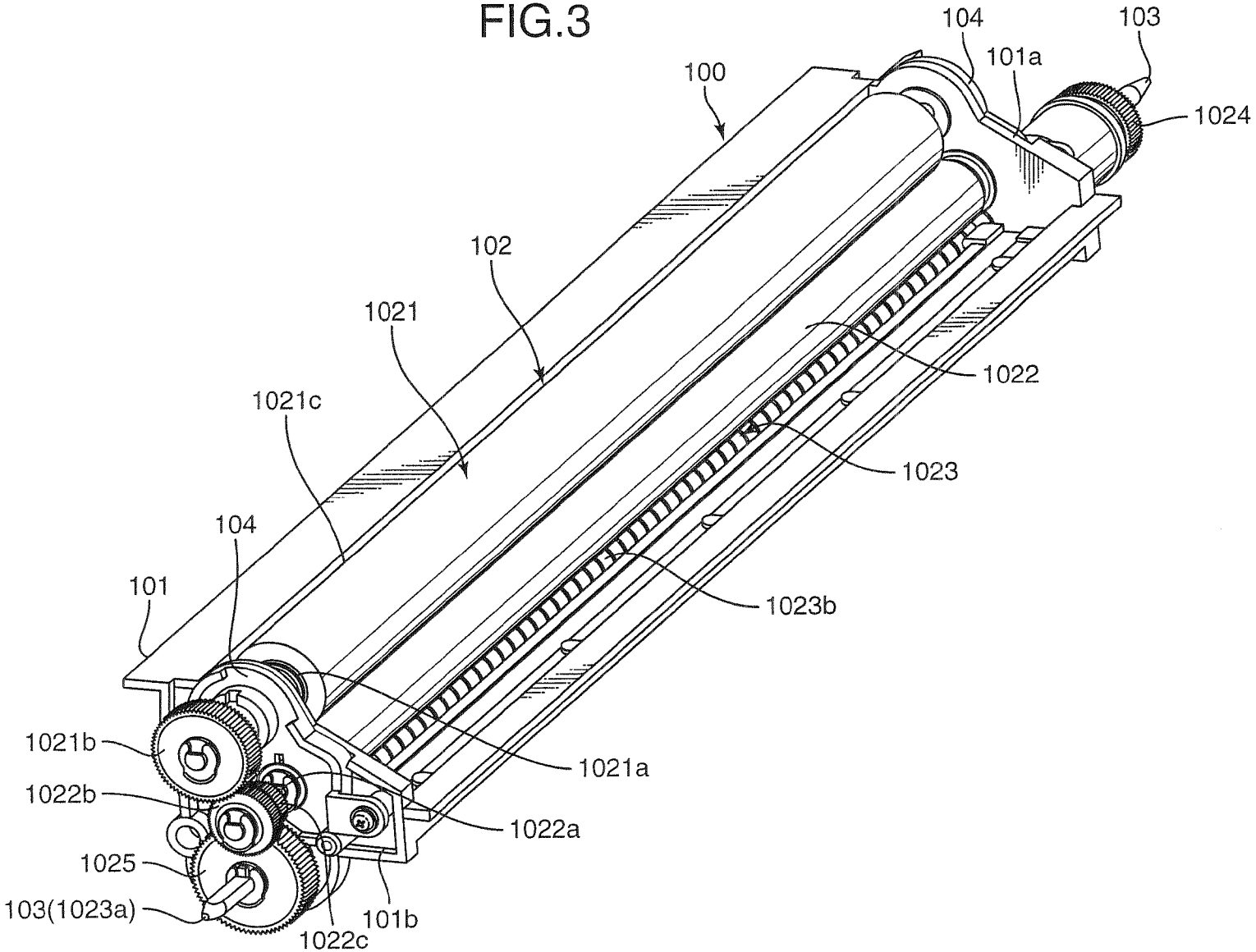
FIG. 3 is a perspective view schematically showing an internal configuration of the cleaning unit.
Figure 4:
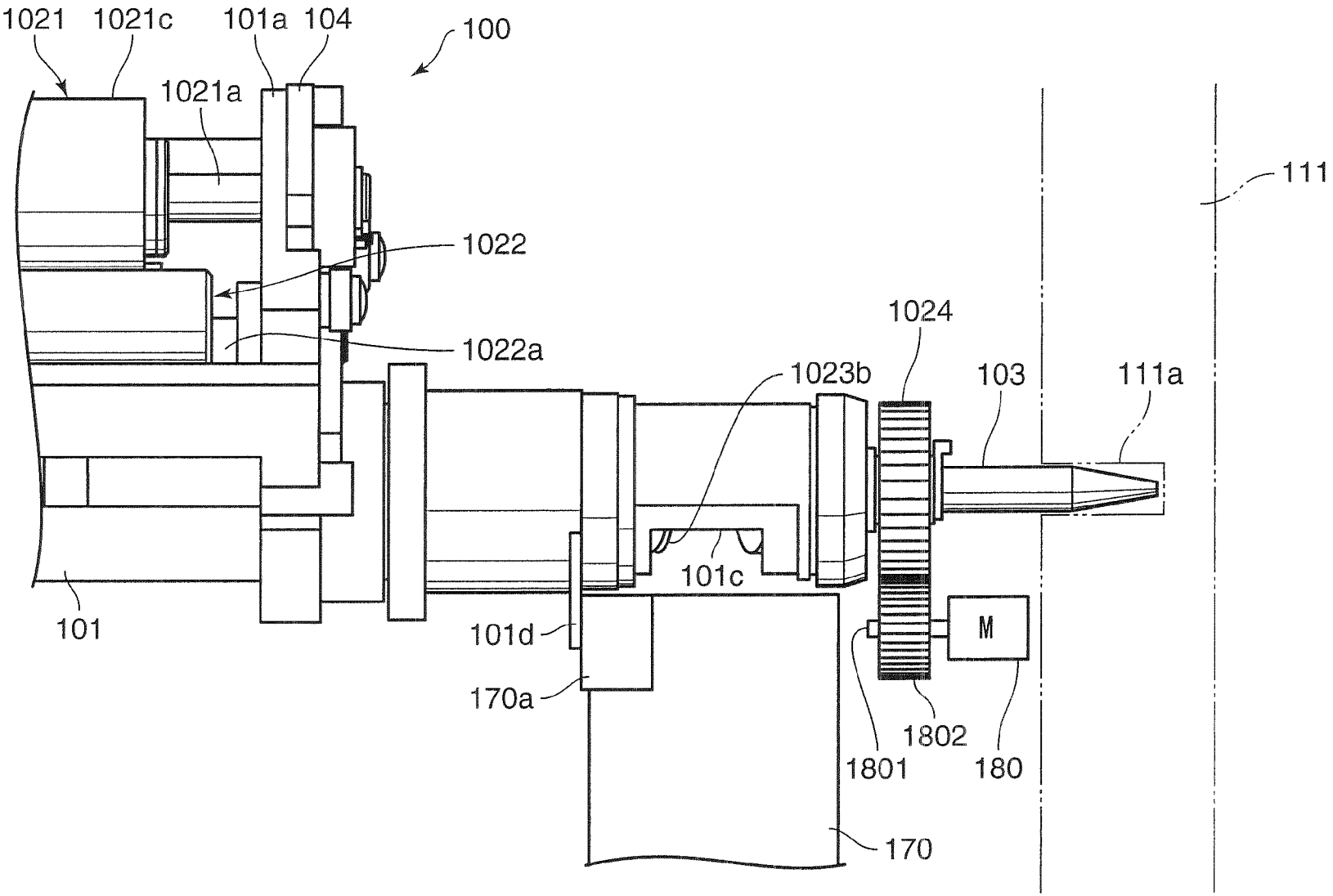
FIG. 4 is a side view showing the cleaning unit and a drive motor, and connection portions of those with a collection pipe.

Next, the cleaning unit 100 will be described. FIG. 3 is a perspective view schematically showing an internal configuration of the cleaning unit 100. FIG. 4 is a side view showing the cleaning unit 100 and a drive motor, and connection portions of those with a collection pipe.

The cleaning unit 100 includes a casing 101, a cleaning mechanism 102, a positioning shaft 103, and an abutting member 104.

The cleaning mechanism 102 is a mechanism for cleaning the front surface side of the intermediate transferring belt 20. The cleaning mechanism 102 includes a cleaning brush (an example of a cleaning roller) 1021, a collecting roller 1022, a conveyance screw 1023, and a drive force input gear 1024.

The cleaning brush 1021 extends in the same direction as a rotational shaft (a direction orthogonal to the running direction of the intermediate transferring belt 20) of each roller such as the driving roller 22 and the tension roller 21 around which the intermediate transferring belt 20 extends. After the cleaning unit 100 is positioned with respect to the apparatus main body 11 and the transfer unit 200 (the positioning will be described later), the cleaning brush 1021 is arranged at a position of facing the driven roller 25 across the intermediate transferring belt 20 and receives a pressure from the driven roller 25 through the intermediate transferring belt 20. The cleaning brush 1021 includes a rotational shaft 1021*a* extending in parallel with the driven roller 25 and axially supported by the casing 101, and a brush portion 1021*c* having a large number of bristles evenly implanted to the peripheral surface of the rotational shaft 1021 so as to extend radially from the rotational shaft 1021*a*. The rotational shaft 1021*a* is axially supported by a side wall 101*a* extending along the direction of the rotational axis and provided in the casing 101. An outer peripheral surface of the brush portion 1021*c* formed by leading ends of the large number of bristles comes in contact with the surface of the intermediate transferring belt 20 after the positioning.

The collecting roller 1022 collects from the cleaning brush 1021 a foreign object removed from the front surface of the intermediate transferring belt 20 by the cleaning brush 1021. The collecting roller 1022 is so provided that a part of the peripheral surface of the collecting roller 1022 comes in contact with the outer peripheral surface of the brush portion 1021*c*. The collecting roller 1022 rotated negatively, or positively with a difference in a peripheral speed with respect to the peripheral surface of the cleaning brush 1021, so that a foreign object is removed from the peripheral surface of the cleaning brush 1021. The peripheral surface of the cleaning brush 1021 comes in contact with the front surface of the intermediate transferring belt 20 again after the cleaning is performed by the collecting roller 1022. The rotational shaft 1022*a* of the collecting roller 1022 is axially supported by the side wall 101*a* of the casing 101.

An unillustrated cleaning blade is provided on the peripheral surface of the collecting roller 1022. The cleaning blade is a blade-like member whose leading edge portion comes in contact with the peripheral surface of the collecting roller 1022. When the collecting roller 1022 is rotated, the leading edge portion of the cleaning blade comes in a sliding contact with the peripheral surface of the collecting roller 1022. Accordingly, a foreign object adhered to the peripheral surface of the collecting roller 1022 is scraped off.

The conveyance screw 1023 is arranged under the collecting roller 1022. The conveyance screw 1023 includes a rotational shaft 1023*a* which extends in the same direction as a rotational shaft of each roller such as the driving roller 22 and the tension roller 21, and a fin member 1023*b* which is provided in spiral on the peripheral surface of the rotational shaft 1023*a* along a length of the rotational shaft 1023*a*. When the conveyance screw 1023 is rotated about the rotational shaft 1023*a* by a drive force exerted by a drive motor which will be described later, the fin member 1023*b* conveys a foreign object, which is removed from the front surface of the intermediate transferring belt 20 by the cleaning brush 1021 and the collecting roller 1022 and falls down from the collecting roller 1022, to a waste toner discharging slot 101*c* connected to a collecting pipe (an example of the collecting mechanism) 170 provided in the apparatus main body 11 in a direction along the rotational shaft 1023*a*.

The rotational shaft 1023*a* of the conveyance screw 1023 is axially supported by the side wall 101*a* of the casing 101. The drive force input gear 1024 is provided on the peripheral surface of the rotational shaft 1023*a*, which projects outward from one of the side walls 101*a* of the casing 101, of the conveyance screw 1023. In other words, a rotational shaft of the drive force input gear 1024 is coaxial with the rotational shaft 1023*a* of the conveyance screw 1023.

The drive force input gear 1024 receives input of a rotational drive force of the cleaning brush 1021 from a drive motor (an example of the drive power source) 180 provided in the apparatus main body 11. The drive force input gear 1024 has the positioning shaft 103 which is provided coaxially with the rotational shaft of the drive force input gear 1024. In other words, the rotational shaft 1023*a* of the conveyance screw 1023 is axially supported by the side wall 101*a* of the casing 101 and projects outwardly from the cleaning unit 100 through the side wall 101*a*, and the projected portion is the positioning shaft 103. On the peripheral surface of the positioning shaft 103 (the rotational shaft 1023*a* of the conveyance screw 1023), the drive force input gear 1024 is provided so as to rotate together with the positioning shaft 103 and the rotational shaft 1023*a*.

On the other hand, in each of the side walls 111 of the apparatus main body 11 as opposite end sides of the transfer unit 200 (in other words, opposite side walls of the apparatus main body 11 at positions facing the mounting positions of the transfer unit 200), there is formed a positioning portion 111*a* to which the positioning shaft 103 is fitted. The positioning portion 111*a* is a hole which is formed in each of the side walls 111 and has substantially the same radius as the positioning shaft 103 of the cleaning unit 100. The positioning shaft 103 is fitted to the positioning portion 111*a* in such a state as to rotate the cleaning unit 100 in a direction of coming in contact with or separating apart from the transfer unit 200. The positioning portion 111*a* is formed in the side wall 111 at a position lower than the intermediate transferring belt 20 in a state where a tension is given by the driven roller 25 and near the front surface of the intermediate transferring belt 20.

The drive motor 180 is provided outside the casing 101 at a suitable portion of the apparatus main body 11. The drive motor 180 gives a rotational drive force to the cleaning brush 1021, the collecting roller 1022, and the conveyance screw 1023. The drive force input gear 1024 is in mesh with the motor-side gear 1802 of the driving shaft 1801 provided in the drive motor 180.

On the other side wall 101*b* which is different from the side wall 101*a* on which the drive force input gear 1024 is provided, there are provided drive gears 1025, 1022*b*, and 1021*b*. At a portion which is the rotational shaft 1023*a* (positioning shaft 103) of the conveyance screw 1023 axially supported on the side wall 101*b* and projects outward from the side wall 101*b*, a drive force transmission gear 1025 is provided so as to rotate together with the rotational shaft 1023*a*. Further, at a portion which is the rotational shaft 1022*a* of the collecting roller 1022 axially supported on the side wall 101*b* and projects outward from the side wall 101*b*, drive force transmission gears 1022*b* and 1022*c* are provided so as to rotate together with the rotational shaft 1022*a*. The drive force transmission gear 1022*c* is in mesh with the drive force transmission gear 1025.

Further, on the rotational shaft 1021*a* of the cleaning brush 1021 projecting from the side wall 101*b*, a brush driving gear 1021*b* is provided so as to rotate together with the rotational shaft 1021*a*. The brush driving gear 1021*b* is in mesh with the drive force transmission gear 1022*b* of the collecting roller 1022. The mesh of the drive gears 1025, 1022*b*, and 1021*b* transmits a rotational drive force of the drive motor 180 from the conveyance screw 1023 to the cleaning brush 1021 and the collecting roller 1022.

The abutting member 104 is a member which comes in contact with the contact member (which will be described later) of the transfer unit 200. The opposite side walls 101*a* of the casing 101 are so formed as to be positioned apart from the intermediate transferring belt 20 in the direction orthogonal to the running direction of the intermediate transferring belt 20, and the abutting members 104 are provided respectively on the outer wall sides of the side walls 101*a*. The abutting member 104 has an arc shape having the same center as the rotational shaft 1021*a* of the cleaning brush 1021 and projects above the upper portion of the peripheral surface of the cleaning brush 1021 axially supported on the side wall 101*a*.

Figure 5:
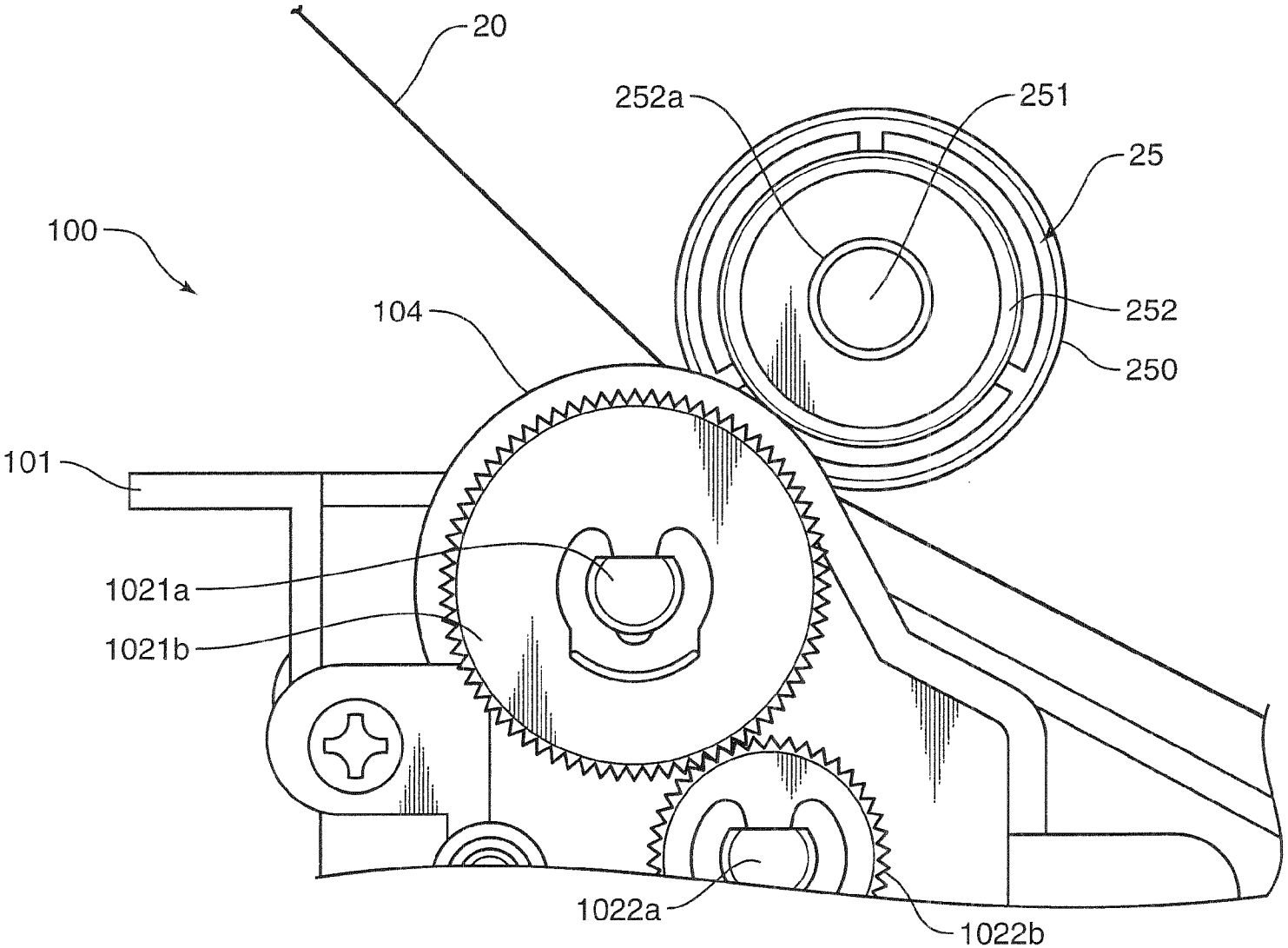
FIG. 5 is a side view showing a state where a contact member on a side of the intermediate transferring belt and an abutting member on a side of the cleaning unit are in contact with each other, viewed from a direction in which a rotational shaft of a cleaning brush extends.
Figure 6:
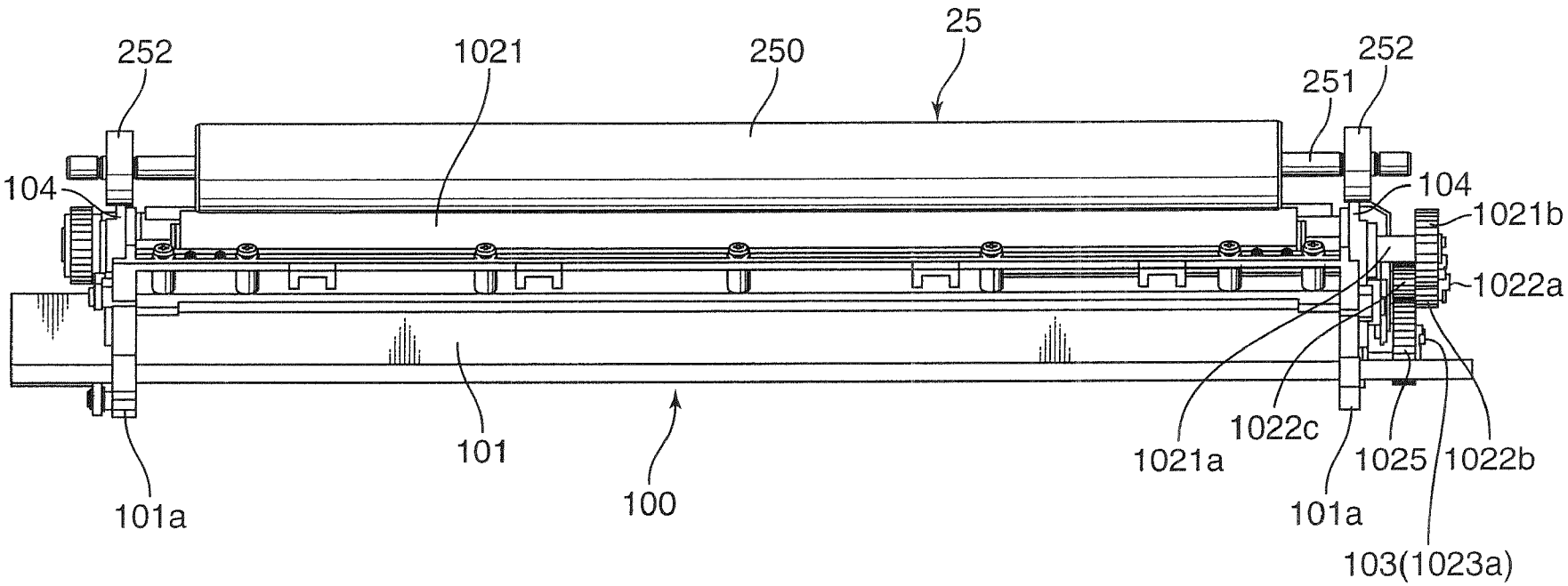
FIG. 6 is a side view showing a state where the contact member on the side of the intermediate transferring belt and the abutting member on the side of the cleaning unit come are in contact with each other, viewed from a direction orthogonal to the rotational shaft of the cleaning brush.
Figure 7:
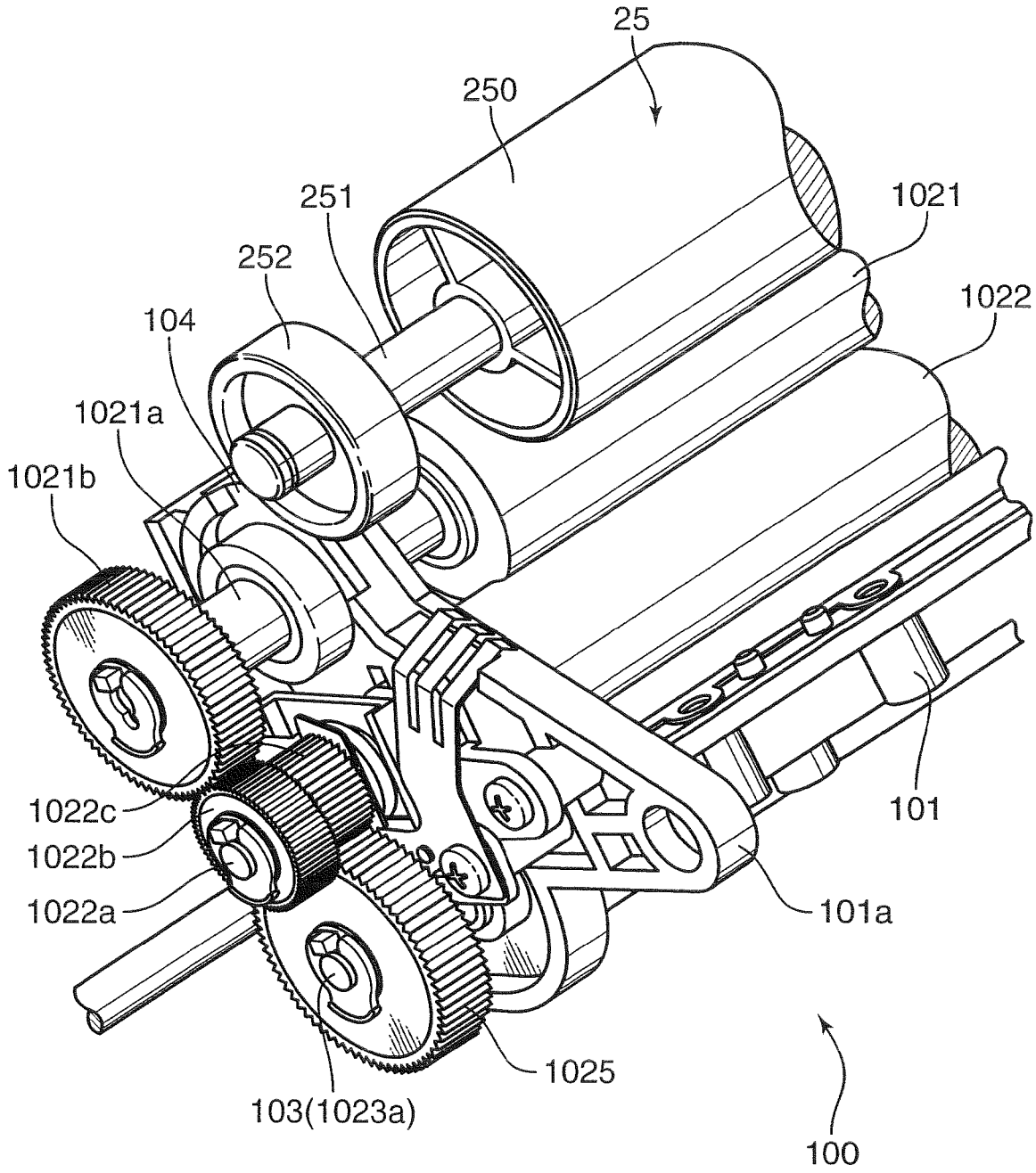
FIG. 7 is a perspective view showing a state where the contact member on the side of the intermediate transferring belt and the abutting member on the side of the cleaning unit are in contact with each other.
Figure 8:
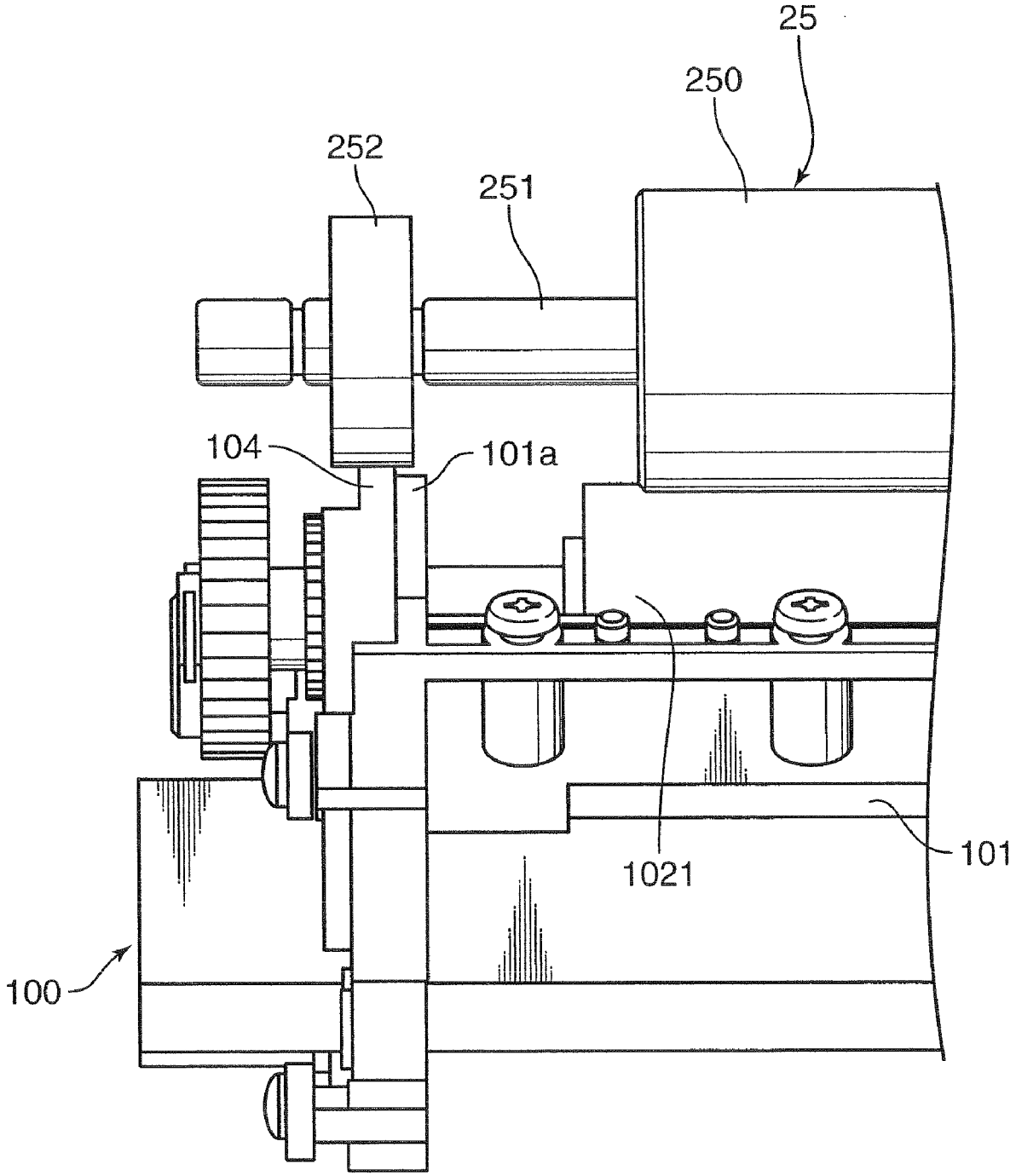
FIG. 8 is a side view showing a state where the contact member on the side of the intermediate transferring belt and the abutting member on the side of the cleaning unit are in contact with each other.

Next, a positioning structure of the cleaning unit 100 provided on the side of the intermediate transferring belt 20 will be described. FIG. 5 is a side view showing a state where the contact member on the side of the intermediate transferring belt 20 and the abutting member 104 on the side of the cleaning unit 100 are in contact with each other, viewed from a direction in which the rotational shaft 1021*a* of the cleaning brush 1021 extends. FIG. 6 is a side view showing a state where the contact member on the side of the intermediate transferring belt 20 and the abutting member 104 on the side of the cleaning unit 100 are in contact with each other, viewed from a direction orthogonal to the rotational shaft 1021*a* of the cleaning brush 1021. FIG. 7 is a perspective view showing a state where the contact member on the side of the intermediate transferring belt 20 and the abutting member 104 on the side of the cleaning unit 100 are in contact with each other. FIG. 8 is a side view showing a state where the contact member on the side of the intermediate transferring belt 20 and the abutting member 104 on the side of the cleaning unit 100 are in contact with each other.

Though not being especially illustrated, opposite end portions of the rotational shaft 251 of the driven roller 25 provided on the transfer unit 200 is axially supported on, for example, the side walls 111 of the apparatus main body 11. On the driven roller 25 provided so as to press the cleaning brush 1021, there is provided the contact member 252 at a portion of the rotating shaft 251 extending from the roller main body 250 in contact with the intermediate transferring belt 20. The contact member 252 has an arc shape having the same center as the rotational shaft 251 of the driven roller 25 and, as shown in FIGS. 6 and 7, is provided at a position apart from the intermediate transferring belt 20. The position of the rotational shaft 251 where the contact member 252 is provided is at a position where the cleaning unit 100 faces the abutting member 104 on the side of the cleaning unit 100 when the positioning shaft 103 is in a state of fitting into the positioning portion 111*a* provided on the side wall 111 of the apparatus main body 11 (position in contact with the abutting member 104).

The contact member 252 has a hole 252*a* formed in its center portion, and the rotational shaft 251 of the driven roller 25 passes through the hole 252*a*. The contact member 252 and the rotational shaft 251 are not adhered to each other. In other words, when the driven roller 25 and the rotational shaft 251 rotate, the contact member 252 does not rotate together with those.

Further, the size of the outer diameter of the contact member 252 is so set that the peripheral surface of the cleaning brush 1021 comes in contact with the intermediate transferring belt 10 at the position of the cleaning unit 100 with respect to the transfer unit 200 in a state where the positioning shaft 103 of the cleaning unit 100 fits into the positioning portion 111*a* of the side wall 111, and the cleaning unit 100 is rotated toward the transfer unit 200, and the abutting member 104 comes in contact with the peripheral surface of the contact member 252.

According to the configuration of the transfer unit 200 and the cleaning unit 100 as described above, at a time of mounting the cleaning unit 100 to the apparatus main body 11, an operator operates the positioning shaft 103 of the cleaning unit 100 to fit into the positioning portion 111*a* formed in the side wall 111 of the apparatus main body 11. If the cleaning unit 100 is rotated in the direction of coming close to the transfer unit 200 to the position where the abutting member 103 comes in contact with the contact member 252 on the side of the transfer unit 200 as shown in FIG. 5 in such state where the positioning shaft 103 is fitted into the positioning portion 111*a*, the cleaning unit 100 is positioned with respect to the transfer unit 200 and the apparatus main body 11 at a position where the peripheral surface of the cleaning brush 1021 comes in contact with the surface of the intermediate transferring belt 20, as shown in FIGS. 6 and 7. Accordingly, accuracy in the positioning at the time of mounting the cleaning unit 100 in the apparatus main body 11, and the positioning of the cleaning unit 100 with respect to the transfer unit 200 can be easily secured.

As shown in FIG. 4, the degree of entering of the positioning shaft 103 with respect to the positioning portion 111*a* may be determined based on a depth (width) of the recession of the positioning portion 111*a*. Alternatively, as shown in FIG. 4, it may be determined by the contact of the abutting plate 101*d* formed in the side wall 101*a* of the cleaning unit 100 with the positioning member 170*a* provided in the collection pipe 170.

Figure 9:
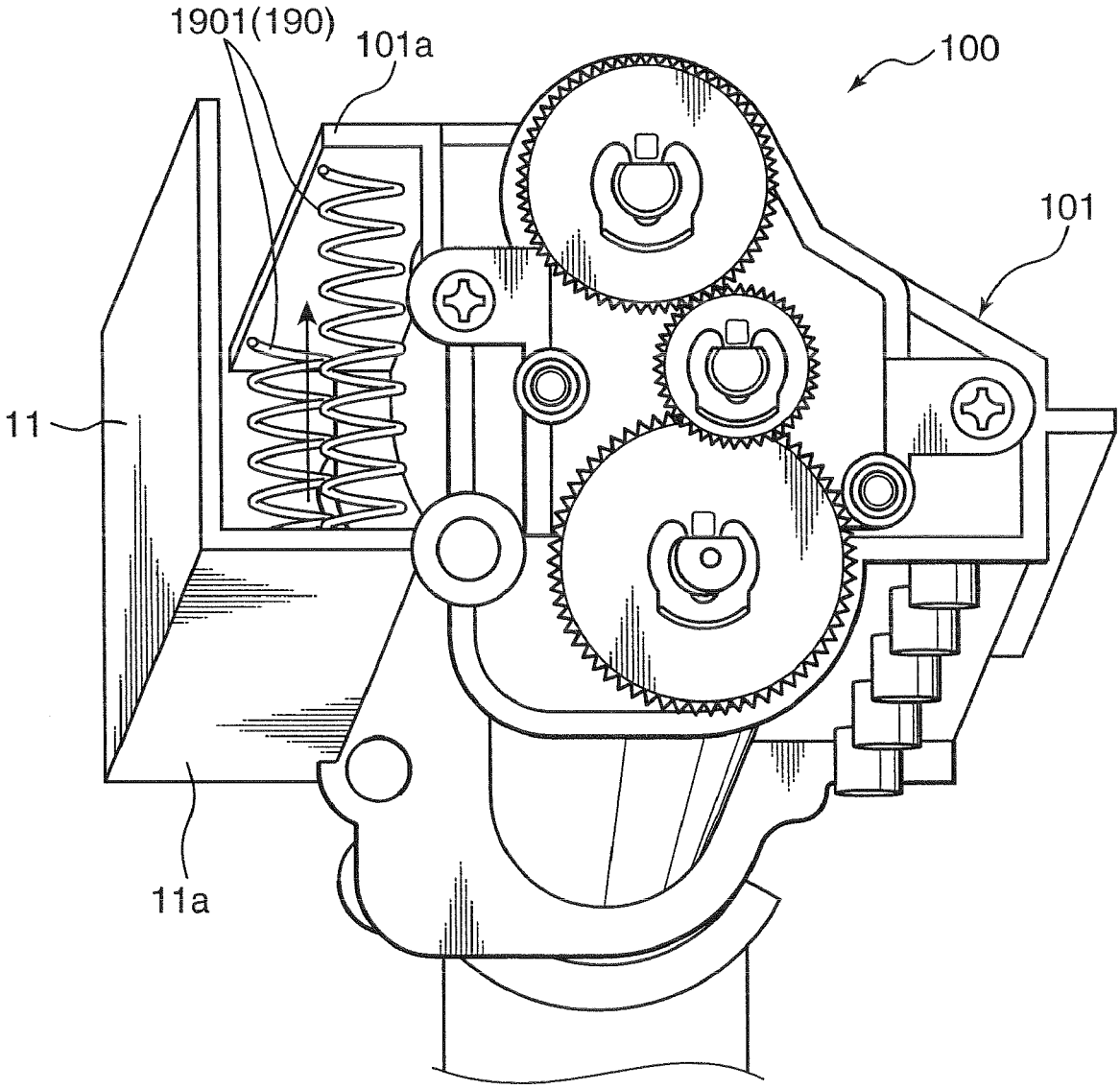
FIG. 9 is a perspective view showing an embodiment of a pressing mechanism.
Figure 10:
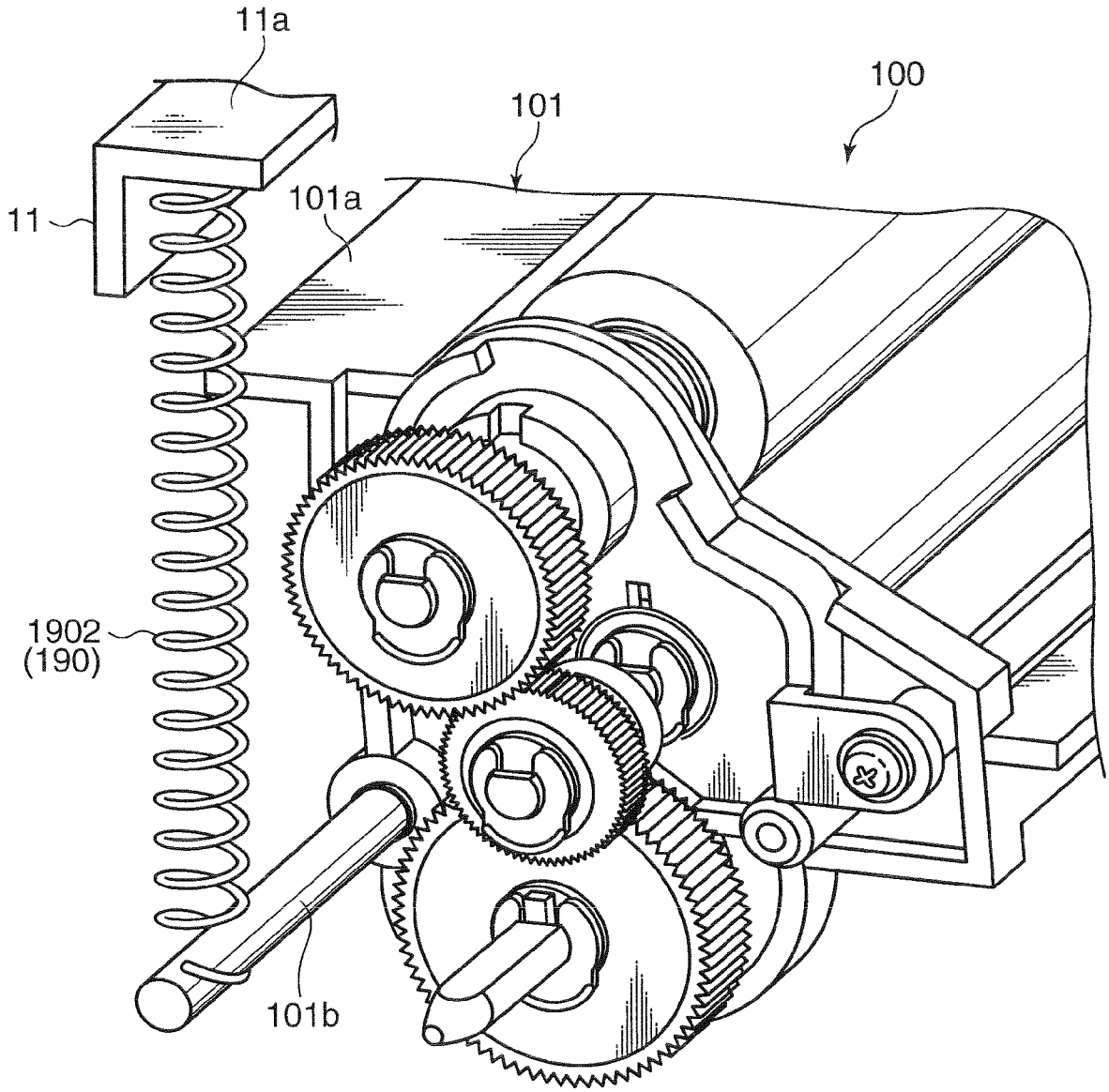
FIG. 10 is a perspective view showing another embodiment of the pressing mechanism.

Further, as shown in FIGS. 9 and 10, in the apparatus main body 11, there is provided a pressing mechanism 190 which presses the cleaning unit 100, which is in a state where the positioning shaft 103 is fitted into the positioning portion 111*a*, toward the side of the transfer unit 200.

For example, the pressing mechanism 190 shown in FIG. 9 has the following configuration. The projecting portion 11*a* of the image forming apparatus main body 11 extends toward the side of the cleaning unit 100. The projecting portion 11*a* and a part 101*a* of the casing 101 are so arranged that the part 101*a* of the casing 101 of the cleaning unit 100 in a state where the positioning shaft 103 is fitted into the positioning portion 111*a* is positioned above the projecting portion 11*a*. On an upper surface of the projecting portion 11*a* (a surface facing the part 101*a* of the casing 101) there is provided one or a plurality of pushing springs 1901 (pressing mechanism 190). An upper end portion of the pushing spring 1901 comes in contact with a lower surface of the part 101*a* of the casing 101 and pushes the part 101*a* upward. As shown in FIG. 1 and FIG. 5, since the transfer unit 200 is positioned above the cleaning unit 100, the pushing operation of the pushing spring 1901 rotates the cleaning unit 100 about the positioning shaft 103 as a rotational shaft and pushes the cleaning unit 100 toward the transfer unit 200.

For example, the pressing mechanism 190 shown in FIG. 10 has the following configuration. The projecting portion 11*a* of the image forming apparatus main body 11 extends on the side of the cleaning unit 100. On the side portion of the cleaning unit 100, there is provided a shaft 101*b* which extends in the same direction as the positioning shaft 103, and a pulling spring 1902 (pressing mechanism 190) is provided on the shaft 101*b*. The projecting portion 11*a* is provided above the shaft 101*b* and the pulling spring 1902. An upper end portion of the pulling spring 1902 is attached to a lower surface of the projecting portion 11*a*, and the pulling spring 1902 pulls the axis 101*b* upward. As shown in FIGS. 1 and 5, since the transfer unit 200 is positioned above the cleaning unit 100, a pulling tensional force of the pulling spring 1902 causes the cleaning unit 100 to rotate about the positioning shaft 103 as a rotational shaft and is pushed toward the transfer unit 200.

The pressing mechanism 190 retains a posture of the cleaning unit 100 with respect to the transfer unit 200 and maintains a state in which the peripheral surface of the cleaning brush 1021 is in contact with the surface of the intermediate transferring belt 20. At the time of pressing, a force is exerted to the cleaning unit 100 to move toward the side of the transfer unit 200. However, since the rotational shaft of the drive force input gear 1024 which receives transmission of a rotational drive force from the drive motor 180 is provided on the same shaft as the positioning shaft 103 which is fitted into the positioning portion 111*a* of the apparatus main body 11, even if the cleaning unit 100 receives a pressing force of the pressing mechanism 190 toward the side of the transfer unit 200, the position of the drive force input gear 1024 in the apparatus main body 11 is fixed without changing, and the drive force input gear 1024 and the motor-side gear 1802 of the drive motor 180 are maintained in a state of being in mesh. Since the drive gears 1024, 1022*b*, 1022*c*, and 1021*b* are provided on the rotational shafts axially supported on the side wall 100*a* of the cleaning unit 100, the state of drive gears 1024, 1022*b*, 1022*c*, and 1021*b* in mesh are maintained without being affected by the pressing force exerted by the pressing mechanism toward the side of the transfer unit 200.

Further, the present invention includes the following contents.

(a) In the aforementioned embodiment, the printer 10 is described as an example of the image forming apparatus according to the present invention. However, the present invention is not limited to that the image forming apparatus is the printer 10 but may be a copying machine, a facsimile machine, a complex machine, or the like.

(b) In the aforementioned embodiment, the intermediate transferring belt 20 on which a color image is formed in superimposition on a belt surface is adopted as a transfer belt. However, in place of the intermediate transferring belt 20, a so-called sheet-conveying belt which forms a color image onto a sheet conveyed on a belt may be adopted as a transfer belt according to the present invention. Further, in the aforementioned embodiment, an image bearing member adopting a plurality of photoconductive drums 131 for respective colors is shown. However, a color printing image bearing member of so-called one-drum type which sequentially forms toner images of respective colors onto a peripheral surface of one photoconductive drum. Further, the image forming apparatus according to the present invention is not limited to the one for color printing but may be for monochromatic printing. In this case, surely, only one photoconductive drum is adopted.

(c) In the aforementioned embodiment, the contact member 252 is provided on the driven roller 25. However, the contact member 252 is not necessarily provided on the driven roller 25. For example, at a position near the driven roller 25 in the apparatus main body 11, a contact member 252 may be provided as a member which is separate from the driven roller 25.

(1) In summary, an image forming apparatus in accordance with an aspect of the present invention includes: a transfer unit; a cleaning unit; and an apparatus main body to which the transfer unit and the cleaning unit are mounted. The transfer unit includes: a plurality of rollers; an image forming section which performs formation of a toner image in accordance with image information and transfer of the toner image; a transfer belt which extends between the plurality of rollers so as to be capable of running in an endless manner, the transfer belt receiving on its front surface or a recording sheet placed on the front surface a toner image which is transferred from the image forming section; and a contact member which comes in contact with a part of the cleaning unit at a position apart from the transfer belt to perform positioning of the cleaning unit. The apparatus main body includes: a positioning portion which is used for positioning the cleaning unit. The cleaning unit includes: a cleaning mechanism which cleans the front surface side of the transfer belt; a positioning shaft which fits into the positioning portion formed in the apparatus main body of the image forming apparatus, the positioning shaft being rotatable in such a direction that the cleaning unit comes in contact with or separates apart from the transfer unit; and an abutting member which comes in contact with the contact member of the transfer unit.

According to this invention, for example, an operator allows the positioning shaft of the cleaning unit to fit into the positioning portion in the image forming apparatus main body, and rotates the cleaning unit in the direction of coming close to the transfer unit to a position where the abutting member comes in contact with the contact member in such state where the positioning shaft is fitted into the positioning portion, so that accuracy in positioning in the image forming apparatus main body at a time of mounting the cleaning unit to the image forming apparatus and positioning of the cleaning unit and the transfer unit can be easily secured. Further, by mounting the cleaning unit in such a manner, the cleaning unit can be detachably mounted to the image forming apparatus independently from the image forming apparatus main body, economic efficiency and maintainability at a time of replacing failed parts and wear-out parts improve.

For example, in an image forming apparatus adopting a unit in which a transfer mechanism, which retains an intermediate transferring belt, and a cleaning mechanism are integrated, even if only the intermediate transferring belt should be replaced, the intermediate transferring belt can be replaced unless all parts (image forming section and belt-driving roller) placed around the outer peripheral surface of the intermediate transferring belt of the integrated unit are replaced. In other words, according to the present invention the cleaning unit can be so configured as to be detachably mounted to the image forming apparatus independently from the transfer unit. Further, at the time of mounting the cleaning unit of the integrated unit and the transfer unit independently to the image forming apparatus main body, accuracy in positioning of the cleaning unit and the transfer unit in the image forming apparatus main body and relative positioning of the mechanism can be secured.

(2) Further, according to an aspect of the present invention, a pressing mechanism which presses the cleaning unit against the transfer unit is provided in the apparatus main body.

According to this invention the pressing mechanism presses the cleaning unit against the transfer unit. Accordingly, the cleaning unit in a state where the positioning shaft is fitted into the positioning portion is retained at a position where the abutting member is in contact with the contact member.

(3) Further, according to an aspect of the present invention, the cleaning mechanism of the cleaning unit includes: a cleaning roller which has a rotational shaft extending in the same direction as a rotational shaft of each roller around which the transfer belt extends, the cleaning roller coming in contact with a front surface side of the transfer belt; and a drive force input gear to which a rotational drive force to the cleaning roller is inputted from a drive power source which is provided in the apparatus main body, and the positioning shaft is provided coaxially on the rotational shaft of the drive force input gear.

According to this invention, the positioning shaft of the cleaning unit is provided on the same shaft as the rotational shaft of the drive force input gear to which a rotational drive force to the cleaning roller is inputted from the drive power source, an accuracy in positioning the drive force input gear with respect to the image forming apparatus can be highly secured. Accordingly, an accuracy in positioning between the drive force input gear and the drive power source is secured at the connection point where a rotational drive force is inputted to the drive force input gear from the drive power source provided in the image forming apparatus main body, so that a rotational drive force can be transmitted accurately.

(4) Further, according to an aspect of the present invention, the transfer unit further includes a driven roller which presses the transfer belt against the cleaning roller at a position of facing the cleaning roller of the cleaning unit, and the contact member has an arc shape being concentric with the rotational shaft of the driven roller and is provided at a position apart from the transfer belt, and the abutting member of the cleaning unit is configured by a member having an arc shape being concentric with the rotational shaft of the cleaning roller.

According to this invention, the contact member of the transfer unit has an arc shape having the same center as the rotational shaft of the driven roller which presses the transfer belt against the cleaning roller, and the abutting member of the cleaning unit has an arc shape having the same center as the rotational shaft of the cleaning roller. Accordingly, a positional accuracy between the position of the transfer belt pressed by the driven roller and subjected to cleaning and the cleaning roller improves when the contact member and the abutting member come in contact with each other at the time of positioning the both units. For example, the amount of pressure of the cleaning roller against the transfer belt can be stabilized.

(5) Further, according to an aspect of the present invention, the cleaning mechanism of the cleaning unit further includes: a conveyance screw which has a rotational shaft extending in the same direction as a rotational shaft of each roller, the conveyance screw conveying a foreign object removed by the cleaning roller from the surface of the transfer belt in the rotational direction to a position of the collecting mechanism provided in the apparatus main body, and the rotational shaft of the conveyance screw and the positioning shaft are provided coaxially on the rotational shaft of the drive force input gear.

According to this invention, an accuracy in positioning between the drive force input gear and the drive power source is secured at a connection point to which a rotational drive force is transmitted from the drive power source to the drive force input gear. Also, since the rotational shaft of the drive force input gear to which the rotational drive force for the cleaning roller is inputted and the rotational shaft of the conveyance screw have the same shaft, and a mechanism (gear) for transmitting a rotational drive force from the drive power source to the rotational shaft of the conveyance screw is not necessary, a path for transmitting a drive force can be shortened which is exerted from the drive power source to rotate the conveyance screw and the cleaning roller.

(6) Further, a transfer unit in accordance with an aspect of the present invention is mounted to an apparatus main body of the image forming apparatus and includes: a plurality of rollers; an image forming section which performs formation of a toner image in accordance with image information and transfer of the toner image; a transfer belt which extends between the plurality of rollers so as to be capable of running in an endless manner, the transfer belt receiving on its front surface or a recording sheet placed on the front surface a toner image which is transferred from the image forming section; and a contact member which comes in contact with a part of the cleaning unit at a position apart from the transfer belt to perform positioning of the cleaning unit. The transfer unit is dismountably mounted to the apparatus main body of the image forming apparatus.

(7) Further, according to an aspect of the present invention, the transfer unit further includes: a driven roller which presses the transfer belt against the cleaning roller at a position of facing the cleaning roller of the cleaning unit, and the contact member has an arc shape being concentric with the rotational shaft of the driven roller and is provided at a position apart from the transfer belt.

(8) Further, a cleaning unit in accordance with another aspect of the present invention is mounted to an apparatus main body of an image forming apparatus including a transfer unit having a transfer belt, and the cleaning unit includes: a cleaning mechanism which cleans a front surface side of the transfer belt; a positioning shaft which rotatably fits into a positioning portion formed in the apparatus main body; and an abutting member which comes in contact with a part of the transfer unit, and the cleaning unit is fixed to the apparatus main body of the image forming apparatus in a state where the positioning shaft fits into the positioning portion and the abutting member comes in contact with the contact member.

According to these inventions, at the time of mounting the cleaning unit, accuracy in the positioning in the image forming apparatus main body and the positioning between the cleaning unit and the transfer unit can be easily secured.

This application is based on Japanese Patent application serial No. 2008-021354 filed in Japan Patent Office on Jan. 31, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a transfer unit;

a cleaning unit;

an apparatus main body to which the transfer unit and the cleaning unit are mounted; and a pressing unit provided in the apparatus main body and pressing the cleaning unit against the transfer unit, wherein the transfer unit includes:

a plurality of rollers;

an image forming section which performs formation of a toner image in accordance with image information and transfer of the toner image;

a transfer belt which extends between the plurality of rollers so as to be capable of running in an endless manner, the transfer belt receiving on its front surface or a recording sheet placed on the front surface a toner image which is transferred from the image forming section; and a contact member which comes in contact with a part of the cleaning unit at a position apart from the transfer belt to perform positioning of the cleaning unit, and the apparatus main body includes:

a positioning portion which is used for positioning the cleaning unit, and the cleaning unit includes:

a cleaning mechanism which cleans the front surface side of the transfer belt;

a positioning shaft which fits into the positioning portion formed in the apparatus main body of the image forming apparatus, the positioning shaft being rotatable in such a direction that the cleaning unit comes in contact with or separates apart from the transfer unit; and an abutting member which comes in contact with the contact member of the transfer unit.

2. An image forming apparatus comprising:

a transfer unit;

a cleaning unit; and an apparatus main body to which the transfer unit and the cleaning unit are mounted, wherein the transfer unit includes:

a plurality of rollers;

an image forming section which performs formation of a toner image in accordance with image information and transfer of the toner image;

a transfer belt which extends between the plurality of rollers so as to be capable of running in an endless manner, the transfer belt receiving on its front surface or a recording sheet placed on the front surface a toner image which is transferred from the image forming section; and a contact member which comes in contact with a part of the cleaning unit at a position apart from the transfer belt to perform positioning of the cleaning unit, and the apparatus main body includes:

a positioning portion which is used for positioning the cleaning unit, and the cleaning unit includes:

a cleaning mechanism which cleans the front surface side of the transfer belt;

a positioning shaft which fits into the positioning portion formed in the apparatus main body of the image forming apparatus, the positioning shaft being rotatable in such a direction that the cleaning unit comes in contact with or separates apart from the transfer unit; and an abutting member which comes in contact with the contact member of the transfer unit, wherein the cleaning mechanism of the cleaning unit includes:

a cleaning roller which has a rotational shaft extending in the same direction as a rotational shaft of each roller around which the transfer belt extends, the cleaning roller coming in contact with a front surface side of the transfer belt; and a drive force input gear to which a rotational drive force to the cleaning roller is inputted from a drive power source which is provided in the apparatus main body, and the positioning shaft is provided coaxially on the rotational shaft of the drive force input gear.

3. The image forming apparatus according to claim 1, wherein the transfer unit further includes a driven roller which presses the transfer belt against the cleaning roller at a position of facing the cleaning roller of the cleaning unit, and the contact member has an arc shape being concentric with the rotational shaft of the driven roller and is provided at a position apart from the transfer belt, and the abutting member of the cleaning unit is configured by a member having an arc shape being concentric with the rotational shaft of the cleaning roller.

4. The image forming apparatus according to claim 2, wherein the cleaning mechanism of the cleaning unit further includes:

a conveyance screw which has a rotational shaft extending in the same direction as a rotational shaft of each roller, the conveyance screw conveying a foreign object removed by the cleaning roller from the surface of the transfer belt in the rotational direction to a position of the collecting mechanism provided in the apparatus main body, and the rotational shaft of the conveyance screw and the positioning shaft are provided coaxially on the rotational shaft of the drive force input gear.

5. A transfer unit which is mounted to an apparatus main body of an image forming apparatus, comprising:

a plurality of rollers;

an image forming section which performs formation of a toner image in accordance with image information and transfer of the toner image;

a transfer belt which extends between the plurality of rollers so as to be capable of running in an endless manner, the transfer belt having a front surface facing away from the rollers and receiving on the front surface or a recording sheet placed on the front surface a toner image which is transferred from the image forming section;

a cleaning unit with a cleaning mechanism that cleans the front surface of the transfer belt; and a contact member which comes in contact with a part of the cleaning unit at a position apart from the transfer belt to perform positioning of the cleaning unit, wherein the transfer unit is dismountably mounted to the apparatus main body of the image forming apparatus, and wherein a pressing mechanism is provided in the apparatus main body and presses the cleaning unit against the transfer unit.

6. The transfer unit according to claim 5, further comprising:

a driven roller which presses the transfer belt against the cleaning roller at a position of facing the cleaning roller of the cleaning unit, wherein the contact member has an arc shape being concentric with the rotational shaft of the driven roller and is provided at a position apart from the transfer belt.

7. A cleaning unit which is mounted to an apparatus main body of an image forming apparatus including a transfer unit having a transfer belt which extends between a plurality of rollers so as to be capable of running in an endless manner, the transfer unit further having a contact member at a position spaced apart from the transfer belt, comprising:

a cleaning mechanism which cleans a front surface side of the transfer belt;

a positioning shaft which rotatably fits into a positioning portion formed in the apparatus main body; and an abutting member which comes in contact with a part of the transfer unit, wherein the cleaning unit is fixed to the apparatus main body of the image forming apparatus in a state where the positioning shaft fits into the positioning portion and the abutting member comes in contact with the contact member, and wherein the cleaning mechanism includes:

a cleaning roller which has a rotational shaft extending in the same direction as a rotational shaft of each roller around which the transfer belt extends, the cleaning roller coming in contact with a front surface side of the transfer belt; and a drive force input gear to which a rotational drive force to the cleaning roller is inputted from a drive power source which is provided on the apparatus main body, and the positioning shaft is provided coaxially on the rotational shaft of the drive force input gear.

8. The cleaning unit according to claim 7, wherein the cleaning mechanism further includes:

the conveyance screw which has a rotational shaft extending in the same direction as a rotational shaft of each roller, the conveyance screw conveying a foreign object removed by the cleaning roller from the surface of the transfer belt in the rotational direction to a position of the collecting mechanism provided in the apparatus main body, and the rotational shaft of the conveyance screw and the positioning shaft are provided coaxially on the rotational shaft of the drive force input gear.

* * * * *